US011473819B2

(12) United States Patent
Gromoll et al.

(10) Patent No.: US 11,473,819 B2
(45) Date of Patent: Oct. 18, 2022

(54) HEAT PUMP FOR USING ENVIRONMENTALLY COMPATIBLE COOLANTS

(71) Applicant: Siemens Energy Global GmbH & Co. KG, Munich (DE)

(72) Inventors: Bernd Gromoll, Baiersdorf (DE); Florian Reissner, Nuremberg (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 1012 days.

(21) Appl. No.: 14/894,676

(22) PCT Filed: May 16, 2014

(86) PCT No.: PCT/EP2014/060081
§ 371 (c)(1),
(2) Date: Nov. 30, 2015

(87) PCT Pub. No.: WO2014/191237
PCT Pub. Date: Dec. 4, 2014

(65) Prior Publication Data

US 2016/0102902 A1 Apr. 14, 2016

(30) Foreign Application Priority Data

May 31, 2013 (DE) ..... 10 2013 210 175.9

(51) Int. Cl.
*F25B 41/20* (2021.01)
*F25B 30/02* (2006.01)
(Continued)

(52) U.S. Cl.
CPC ..... *F25B 41/20* (2021.01); *F25B 30/02* (2013.01); *F25B 40/00* (2013.01); *F25B 49/022* (2013.01);
(Continued)

(58) Field of Classification Search
CPC ..... F25B 30/02; F25B 40/00; F25B 41/04; F25B 49/022
See application file for complete search history.

(56) References Cited

U.S. PATENT DOCUMENTS 4,073,434 A * 2/1978 Dumont ..... F24D 7/00 237/2 B
4,314,448 A * 2/1982 Alefeld ..... F01K 25/00 376/323
(Continued)

FOREIGN PATENT DOCUMENTS

CN 1144989 C 4/2004 ..... F25B 41/00
CN 100449224 C 1/2009 ..... C09K 5/04
(Continued)

OTHER PUBLICATIONS

Reid, Austin D., "Low Temperature Power Generator Using HFE-7000 in a Rankine Cycle," Mechanical Engineering, Master Thesis, San Diego State University, 7 pages, 2010.
(Continued)

*Primary Examiner* — Henry T Crenshaw
(74) *Attorney, Agent, or Firm* — Slayden Grubert Beard PLLC

(57) ABSTRACT

A heat pump includes an internal heat exchanger and a regulating device designed to bring the temperature of the working fluid at the outlet of a compressor to a specifiable minimum difference above the dew point at the same pressure. This allows the use of novel coolants in heat pumps, e.g., coolants having a low dew line slope of under 1000/kJ in the temperature-entropy diagram and characterized by very good safety and environmental properties.

3 Claims, 5 Drawing Sheets

(51) Int. Cl.
*F25B 40/00* (2006.01)
*F25B 49/02* (2006.01)

(52) U.S. Cl.
CPC ... *F25B 2400/01* (2013.01); *F25B 2400/0403* (2013.01); *F25B 2600/0272* (2013.01); *F25B 2600/19* (2013.01); *F25B 2600/2501* (2013.01); *F25B 2700/21152* (2013.01)

(56) References Cited

U.S. PATENT DOCUMENTS

| | | | | |
|---|---|---|---|---|
| 4,441,331 | A * | 4/1984 | Yuyama | F25B 13/00 62/196.3 |
| 5,241,829 | A * | 9/1993 | Irie | F25B 30/02 62/204 |
| 6,581,397 | B1 * | 6/2003 | Taira | F25B 9/002 62/199 |
| 7,228,693 | B2 | 6/2007 | Helt | 62/176.6 |
| 2003/0061827 | A1 * | 4/2003 | Sakakibara | F25B 9/008 62/224 |
| 2004/0107720 | A1 * | 6/2004 | Matsumoto | F25B 1/10 62/324.6 |
| 2004/0148961 | A1 * | 8/2004 | Clodic | B01D 53/002 62/532 |
| 2005/0166607 | A1 * | 8/2005 | Brasz | C09K 5/045 62/114 |
| 2006/0005571 | A1 * | 1/2006 | Lifson | F25B 40/00 62/498 |
| 2006/0053823 | A1 * | 3/2006 | Taras | F24F 3/153 62/513 |
| 2006/0218965 | A1 * | 10/2006 | Manole | F25B 40/00 62/513 |
| 2010/0192607 | A1 * | 8/2010 | Unezaki | F25B 13/00 62/238.7 |
| 2013/0098086 | A1 * | 4/2013 | Sillato | F25B 49/02 62/184 |
| 2013/0180272 | A1 * | 7/2013 | Ono | F25B 41/04 62/115 |
| 2014/0208787 | A1 | 7/2014 | Furui et al. | 62/222 |

FOREIGN PATENT DOCUMENTS

| | | | | |
|---|---|---|---|---|
| DE | 3442169 | A1 | 5/1986 | F25B 40/00 |
| DE | 102007011024 | A1 | 9/2008 | B60H 1/32 |
| DE | 102013203243 | A1 | 8/2014 | F24D 3/18 |
| EP | 1632733 | A2 | 3/2006 | F25B 41/06 |
| EP | 2149767 | A1 | 2/2010 | F25B 40/06 |
| EP | 2196745 | A1 | 6/2010 | F25B 1/00 |
| EP | 2716999 | A1 * | 4/2014 | F04C 23/008 |
| JP | 58158460 | A | 9/1983 | F04C 28/26 |
| JP | 10205894 | A | 8/1998 | F25B 1/00 |
| JP | 2001168567 | A | 6/2001 | F25B 1/00 |
| JP | 2002350004 | A | 12/2002 | F25B 1/00 |
| JP | 2007520662 | A | 7/2007 | C09K 5/04 |
| JP | 2009222348 | A | 10/2009 | F25B 1/00 |
| JP | 2009281631 | A | 12/2009 | F25B 1/00 |
| JP | 2012167852 | A | 9/2012 | F22B 3/00 |
| JP | 2013011391 | A | 1/2013 | F25B 1/00 |
| KR | 20090099612 | A | 9/2009 | F25B 1/00 |
| WO | 2011/119456 | A1 | 9/2011 | B23K 35/02 |
| WO | 2013/031218 | A1 | 3/2013 | F25B 1/00 |
| WO | 2012/160832 | A1 | 7/2014 | F04C 23/00 |
| WO | 2014/191237 | A1 | 12/2014 | F25B 30/02 |

OTHER PUBLICATIONS

German Office Action, Application No. 102013210175.9, 9 pages, dated Oct. 4, 2014.
International Search Report and Written Opinion, Application No. PCT/EP2014/060081, 11 pages, dated Oct. 23, 2014.
Korean Office Action, Application No. 2017051196466, 8 pages, dated Jul. 21, 2017.
Canadian Office Action, Application No. 2913947, 3 pages, dated Jan. 12, 2017.
Japanese Office Action, Application No. 2016515716, 4 pages, dated Aug. 21, 2017.
Chinese Office Action, Application No. 201480038694.6, 7 pages, dated Sep. 26, 2016.

* cited by examiner

HEAT PUMP FOR USING ENVIRONMENTALLY COMPATIBLE COOLANTS

CROSS-REFERENCE TO RELATED APPLICATIONS

This application is a U.S. National Stage Application of International Application No. PCT/EP2014/060081 filed May 16, 2014, which designates the United States of America, and claims priority to DE Application No. 10 2013 210 175.9 filed May 31, 2013, the contents of which are hereby incorporated by reference in their entirety.

TECHNICAL FIELD

The present invention relates to heat pumps and to the use of coolants therein.

BACKGROUND

Coolants used hitherto in heat pumps are either toxic or harmful to the environment, i.e. they have high global warming potential. Others are flammable or, the least problematic, at least harmful to health. Approaches known up to now for working with non-toxic, environmentally compatible coolants have to date failed in that these working media cannot provide adequate power of the heat pump or cannot be used in conventional heat pump constructions.

The use of a coolant in a heat pump is characterized by what is termed temperature lift. The temperature lift is the difference between the condensation temperature and the evaporation temperature. The temperature lift thus indicates how much the temperature of the heat source must be raised by in order to be used at the heat sink. FIG. 1 shows, in order to clarify the problem, the phase boundary line of a suitable environmentally friendly coolant, which is characterized by a strongly overhanging dew line. Also shown is a heat pump process for a temperature lift of 50 kelvin from 75° C. evaporation temperature to 125° C. condensation temperature. In order to be able to operate a heat pump with a coolant of this type, the compression endpoint must maintain a minimum temperature difference with respect to the dew line in order to still lie within the gas phase region. If the temperature lift were for example only 20 kelvin, the condensation temperature would then be only 95° C., as shown in FIG. 3, and the compression endpoint would lie inside the phase boundary line, that is to say within the mixed phase region. This would lead to liquid strikes in the compressor and would prevent stable operation of the heat pump.

To date, only one approach is known for the use of such novel working fluids with these special thermodynamic properties, which is targeted at the non-stationary start-up procedure for a heat pump. German patent application 10 2013 203243.9 describes a heat pump with an internal heat exchanger which, as shown graphically in FIG. 2, by subcooling the condensate from state 4 to state 5, transfers the resulting heat to state 7 and thus superheats the intake gas upstream of the compressor. The difference between state and state 5 and the difference between state 7 and state 1 amounts to the same difference in enthalpy as can be found in the pressure-enthalpy diagrams 1 to 4. As can also be seen in FIG. 3, the approach with the internal heat exchanger is not suitable for every temperature lift however. In the case of a temperature lift of for example 20 kelvin, the quantity of heat which the internal heat exchanger can supply for superheating the intake gas is not sufficient and the compression endpoint is once again problematically inside the phase boundary line.

Fluids which have hitherto been used in heat pumps and refrigeration machines, such as for example R134a (1,1,1,2 tetrafluoroethane), do not have the problem that the compression endpoint lies within the two-phase region and can therefore be used with heat pumps and refrigeration machines known from the prior art.

SUMMARY

One embodiment provides a heat pump having a compressor, a condenser, an internal heat exchanger, an expansion valve, an evaporator and a control device, wherein the control device is designed to bring the temperature of the working fluid at the outlet of the compressor to a predefinable minimum temperature difference above the dew point.

In a further embodiment, the control device is designed to bring the temperature of the working fluid at the outlet of the compressor to a predefinable minimum temperature difference of at least 1 kelvin above the dew point.

In a further embodiment, the control device is a temperature control device which is designed to raise the temperature of the working fluid at the inlet to the compressor.

In a further embodiment, the temperature control device comprises a pipe heating unit that is arranged between the internal heat exchanger and the compressor such that the working fluid flowing from the heat exchanger to the compressor can be superheated by means of the pipe heating unit.

In a further embodiment, the temperature control device comprises a bypass line with a valve, which connects the high-pressure region at the outlet of the compressor with the low-pressure region at the inlet to the compressor such that the working fluid flowing from the heat exchanger to the compressor can be superheated by means of the hot gas which can be recirculated via the bypass line.

In a further embodiment, the control device is a pressure control device which is designed to lower the pressure of the working fluid at the inlet to the compressor.

In a further embodiment, the pressure control device comprises an automatic expansion valve which is arranged as an expansion valve in the heat pump circuit between the internal heat exchanger and the evaporator.

In a further embodiment, the heat pump has a working fluid which, in the temperature-entropy diagram, has a gradient of the dew line of less than 1000/kJ.

In a further embodiment, the working fluid has, in the temperature-entropy diagram, a gradient of the dew line of less than 1000/kJ.

Another embodiment provides a method for operating a heat pump in which the temperature of a working fluid after compression is brought to a predefinable minimum temperature difference, in particular 1 kelvin, above the dew point.

BRIEF DESCRIPTION OF THE DRAWINGS

Example embodiments of the present invention are described below with reference to the drawings, in which.

DETAILED DESCRIPTION

Figure 1:
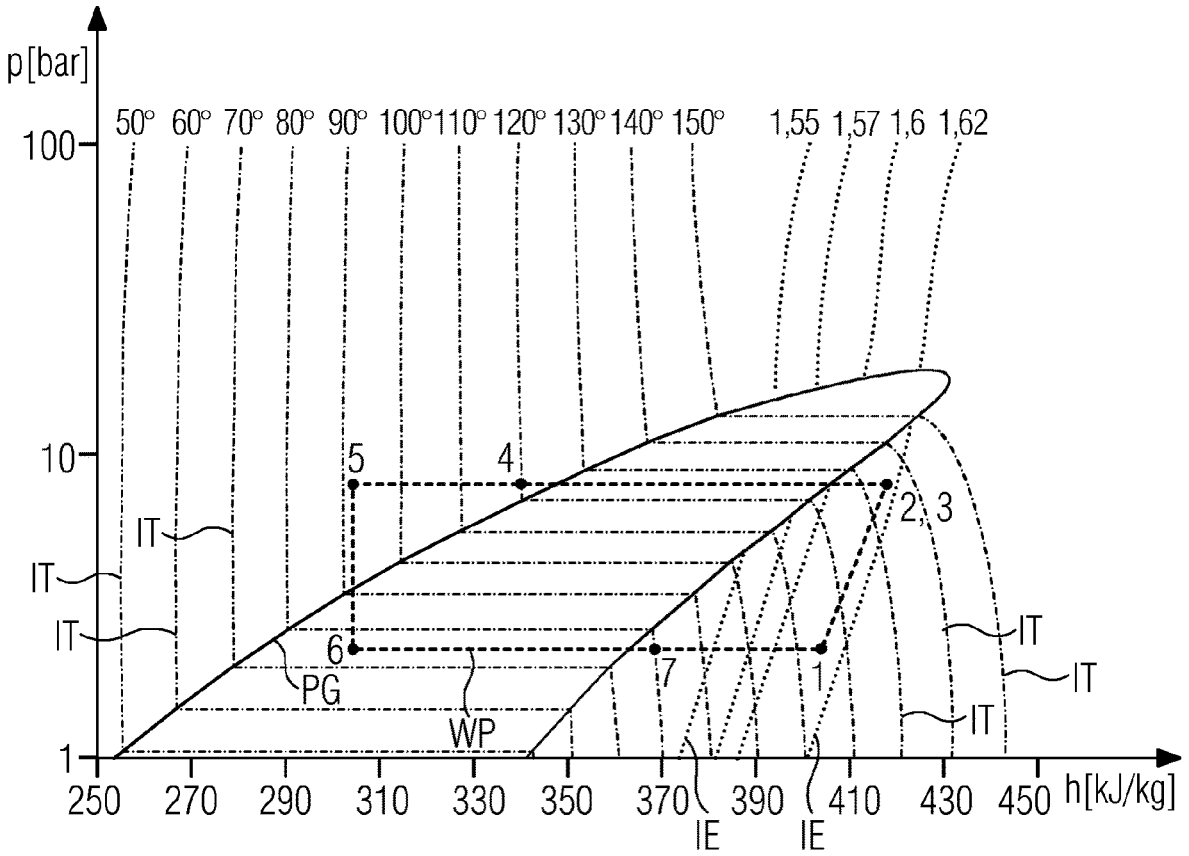
FIG. 1 shows a logarithmic pressure-enthalpy diagram of a novel working medium and a heat pump process performed using this working medium and involving a temperature lift of 50 kelvin.

Embodiments of the present invention provide a heat pump and a method for operating same which permits the use of environmentally friendly working fluids and ensures stable, stationary operation.

Some embodiment provide a heat pump having a compressor, a condenser, an internal heat exchanger, an expansion valve, an evaporator and a control device which is designed to bring the temperature of the working fluid at the outlet of the compressor to a predefinable minimum temperature difference above the dew point. The minimum temperature difference relates to the working fluid at constant pressure and is in particular at least one kelvin, preferably at least 5 kelvin. This has the advantage that it is possible to use environmentally friendly, non-toxic, safe working media which are frequently characterized by very special thermodynamic properties such as for example a very low dew line gradient of less than 1000 (kg $K^2$)/kJ in the temperature-entropy diagram, and stationary, stable heat pump operation is made possible.

In one embodiment of the invention, the control device is a temperature control device which is designed to raise the temperature of the working fluid at the inlet to the compressor. For example, the temperature control device is a pipe heating unit that is arranged between the internal heat exchanger and the compressor such that working fluid flowing from the internal heat exchanger to the compressor can be superheated by means of the pipe heating unit. In that context, the temperature control device is configured such that it controls the pipe heating unit over the temperature of the working fluid at the compressor outlet. Depending on what temperature is measured by the temperature control device at the compressor outlet, the pipe heating unit is switched on or off, or is varied in temperature. The pipe heating unit can therefore for example come on for short periods in the case of fluctuating heat sources or heat sink temperatures or can also be operated for long periods. This has the advantage of equalizing an excessively low temperature lift. The limit temperature for the temperature lift is dependent on the coolant, or working fluid, used. The temperature lift is dependent on various properties and parameters of the heat pump.

In a further example of a heat pump, the temperature control device comprises a bypass line with a valve, which connects the high-pressure region at the outlet of the compressor with the low-pressure region at the inlet to the compressor such that the working fluid flowing from the internal heat exchanger to the compressor can be superheated by means of the hot gas which can be recirculated via the bypass line. In that context, the temperature control device is in particular configured such that it controls the throughput through the valve of the bypass line via the temperature of the working fluid at the compressor outlet. In the case of a temperature lift which, without additional intervention in the heat pump process, would end up with the compression end point in the two-phase region, this embodiment also has the advantage of controlling such that the heat pump with the used working fluid can be operated stably in a stationary state. The used bypass valve can for example be a thermostatically or also an electronically controlled valve.

In one alternative embodiment of the heat pump, the control device is a pressure control device which is designed to lower the pressure of the working fluid at the inlet to the compressor. To that end, the pressure control device can in particular comprise an automatic expansion valve which is arranged as an expansion valve in the heat pump circuit between the internal heat exchanger and the evaporator. An automatic expansion valve is a pure evaporator pressure control valve by means of which it is possible to set the evaporation temperature and accordingly the evaporation pressure.

By lowering the pressure in the evaporator, it is possible to generate a higher pressure ratio $P_{ratio}$ between the pressure side downstream of the compressor and the low-pressure side upstream of the compressor.

The fact that the compressor has to implement a higher pressure ratio $P_{ratio}$ means that a higher compressed gas temperature $T_2$ at the compressor outlet is also produced. The higher the pressure ratio $P_{ratio}$, the higher the temperature $T_2$ of the compressed gas downstream of the compressor.

$$\frac{T_2}{T_1} = P_{ratio}^{\frac{\kappa-1}{\kappa}}$$

Where κ is the isentropic exponent, $T_2$ and $T_1$ are the temperatures downstream and upstream of the compressor and $P_{ratio}$ is the pressure ratio of the gas pressures downstream and upstream of the compressor. As an alternative to raising the temperature $T_1$, it is also possible to lower the pressure upstream of the compressor. Instead of the additional heating power, in this case an additional compressor power is necessary for the increased pressure ratio to be implemented. This embodiment has the advantage of being able to dispense with additional heating elements and temperature control devices and, by replacing the expansion valve with the automatic expansion valve, of requiring no additional components in the heat pump for stationary operation.

The use of an automatic expansion valve in the heat pump has the additional advantage of also presenting a possibility for control for the application case that the temperature lift is not below a limit temperature but substantially above the limit temperature. Indeed, if the temperature lift is too far above this, the compressed gas temperature $T_2$ downstream of the compressor would also be very far above the minimum temperature difference which must be observed with respect to the dew point. This can result in a further problem if for example the compressor has an upper operational temperature limit. Such an upper operational temperature limit of a compressor can for example be imposed by the thermal stability of the lubricants or by excessive expansions for tight fits in the compressor. However, the automatic expansion valve makes it possible to increase the pressure in the evaporator to the point that the working fluid is only slightly superheated or even only partially vaporized. The superheating which is still necessary at that point for the minimum temperature difference with respect to the dew line could be provided by means of the internal heat exchanger. In the case of a temperature lift above the limit temperature, the embodiment with the automatic expansion valve has the additional advantage of raising the overall efficiency of the heat pump on account of the pressure increase since reducing the temperature difference in the evaporator lowers the pressure ratio and less compressor power is required. At the same time, the density of the fluid increases and thus increases the power density in the compressor. In addition, the lower compressed gas temperature can increase the service life of the compressor.

To that end, the heat pump preferably comprises a working fluid which, in the temperature-entropy diagram, has a gradient of the dew line of less than 1000 ($kgK^2$)/kJ. The advantage of using such a working fluid is to be found in its excellent environmental and safety properties. Use can be made for this purpose of, for example, working fluids from the family of the fluoroketones. Particularly advantageous among these are the working fluids Novec649™ (dodecafluoro-2-methylpentan-3-one) and Novec524™ (decafluoro-3-methylbutan-2-one). Novec649™ has a dew line gradient of 601 ($kgK^2$)/kJ, Novec524™ has a dew line gradient of 630 ($kgK^2$)/kJ, and a further suitable example is R245fa (1,1,1,3,3-pentafluoropropane), which has a gradient in the T-S diagram of 1653 ($kgK^2$)/kJ, wherein the gradient is in each case indicated for a saturation temperature of 75° C.

According to embodiments, a heat pump uses a working fluid which has a dew line gradient in the temperature-entropy diagram of less than 1000 ($kgK^2$)/kJ.

In the disclosed method for operating a heat pump, the temperature of a working fluid after compression is brought to a predefinable minimum temperature difference, in particular one kelvin, above the dew point.

FIGS. 1 to 4 show pressure-enthalpy diagrams in which the pressure p is plotted on a logarithmic scale. In diagrams 1, 3 and 4, the isotherms IT are shown in dash-dotted lines and the isentropes IE are shown in dotted lines. In that context, the temperatures for the isotherms IT are given in degrees Celsius, the entropy values for the isentropes IE are given in kJ/(kg·K).

The solid line is in each case the phase boundary line PG of a novel working medium, for example the fluid Novec649™. This has a critical point at 169° C. In the temperature-entropy diagram, the dew line is at a gradient of 601 ($kgK^2$)/kJ. Another suitable example for a working medium is Novec524™ with a critical point at 148° C.

Figure 2:
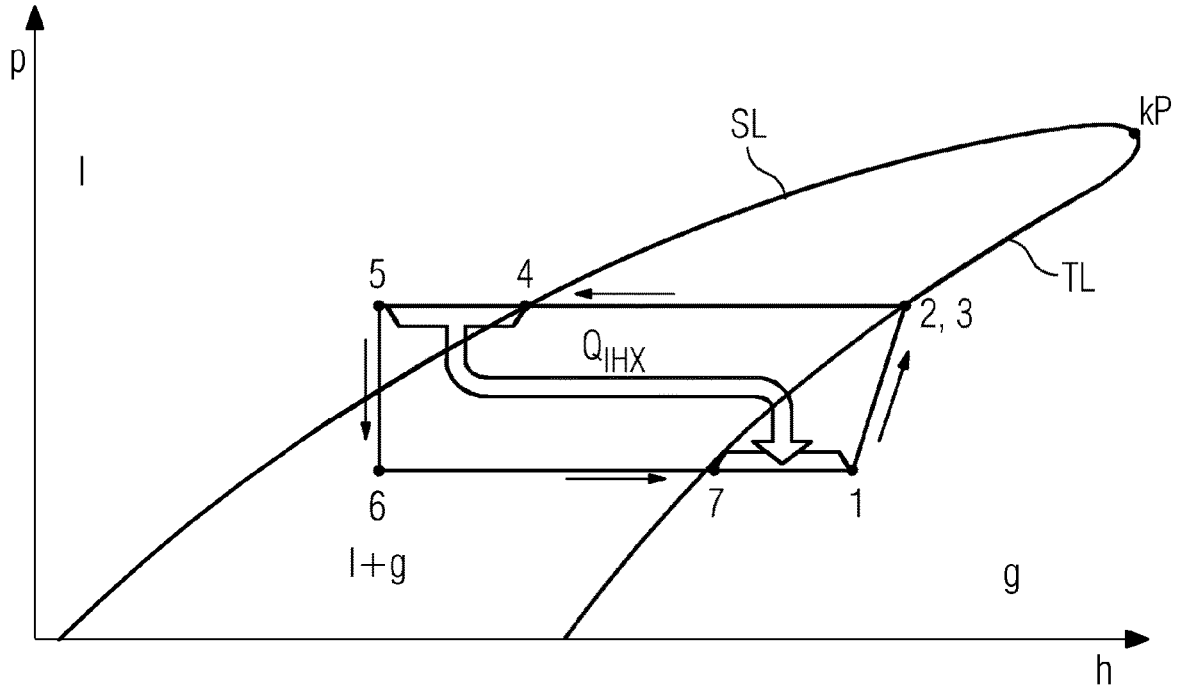
FIG. 2 shows the transfer of heat through the internal heat exchanger in a logarithmic pressure-enthalpy diagram.

FIG. 1 also shows, in dashed lines, a heat pump process WP. Beginning at state point 1, compression results in state point 2 or 3 which, when considered purely theoretically, coincide and in the following will be named only as state point 2. Condensation results in state point 4. From state point 4, subcooling results in state point 5. An expansion procedure lies between state point 5 and state point 6, and an evaporation procedure lies between state point 6 and state point 7. The path from state point 7 back to state point 1 is a superheating of the working medium. The heat pump process WP shown has an evaporation temperature of 75° C. and a condensation temperature of 125° C., that is to say a temperature lift of 50 kelvin. The subcooling from 4 to 5 and the superheating from 7 to 1 are coupled via an internal heat exchanger IHX, as shown in FIG. 2. This uses the heat resulting from the subcooling and transfers it to the state 7. At in each case constant pressure, the enthalpy is reduced during subcooling by the same amount that it is raised during superheating. The distance between state 2 and the dew line TL in the heat pump process WP, i.e. the temperature difference between state 2 and its dew point at the same pressure is 10 kelvin. This minimum difference is sufficient to ensure stable operation of the heat pump 10 without the risk to the compressor 11 of liquid strikes. In order to reliably place the compression endpoint, that is to say state 2, outside the mixed phase region 1+g, that is to say outside the phase boundary line PG, it is necessary to observe a minimum difference which must be established for each system of working fluid and heat pump 10 depending on the possible fluctuation parameters. In particular, however, a minimum difference of one kelvin, advantageously a minimum difference of 5 kelvin, should be observed.

Figure 3:
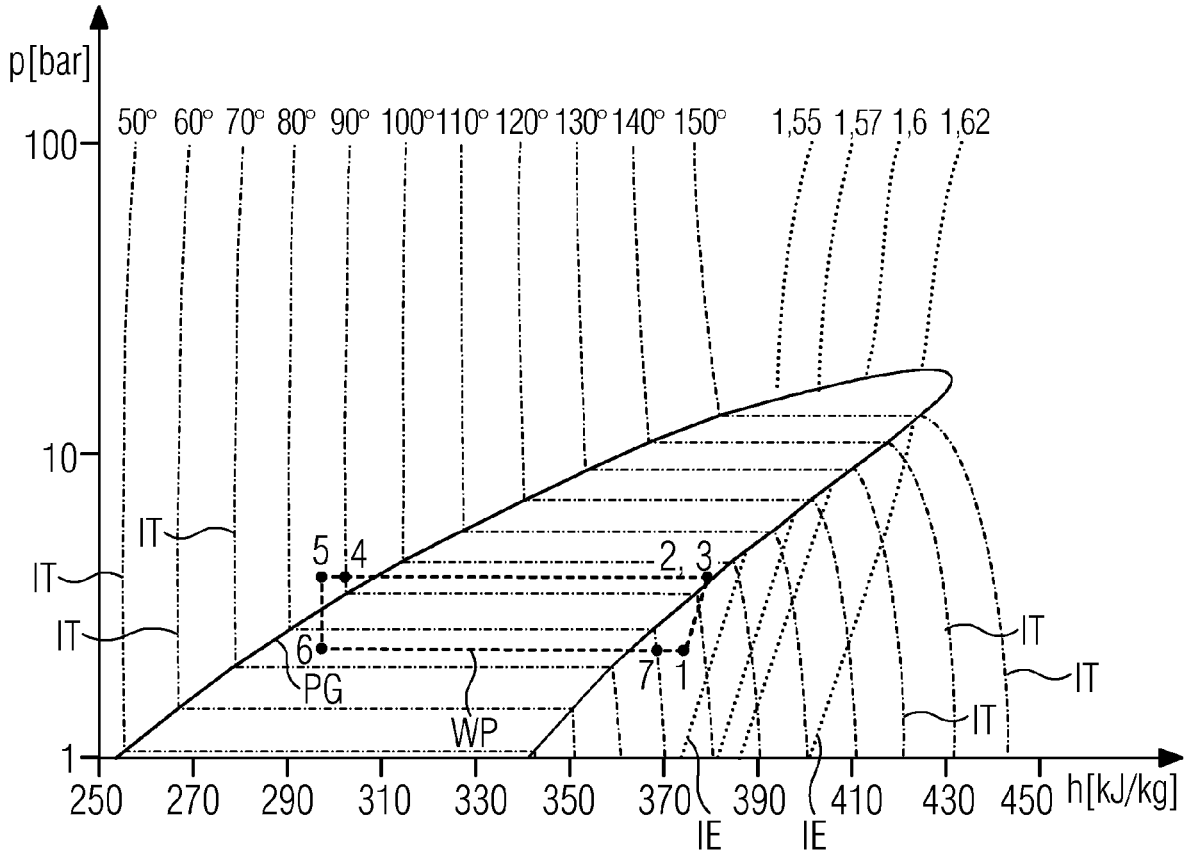
FIG. 3 shows a logarithmic pressure-enthalpy diagram of the working medium as in FIG. 1, with a heat pump process involving a temperature lift of 20 kelvin.
Figure 4:
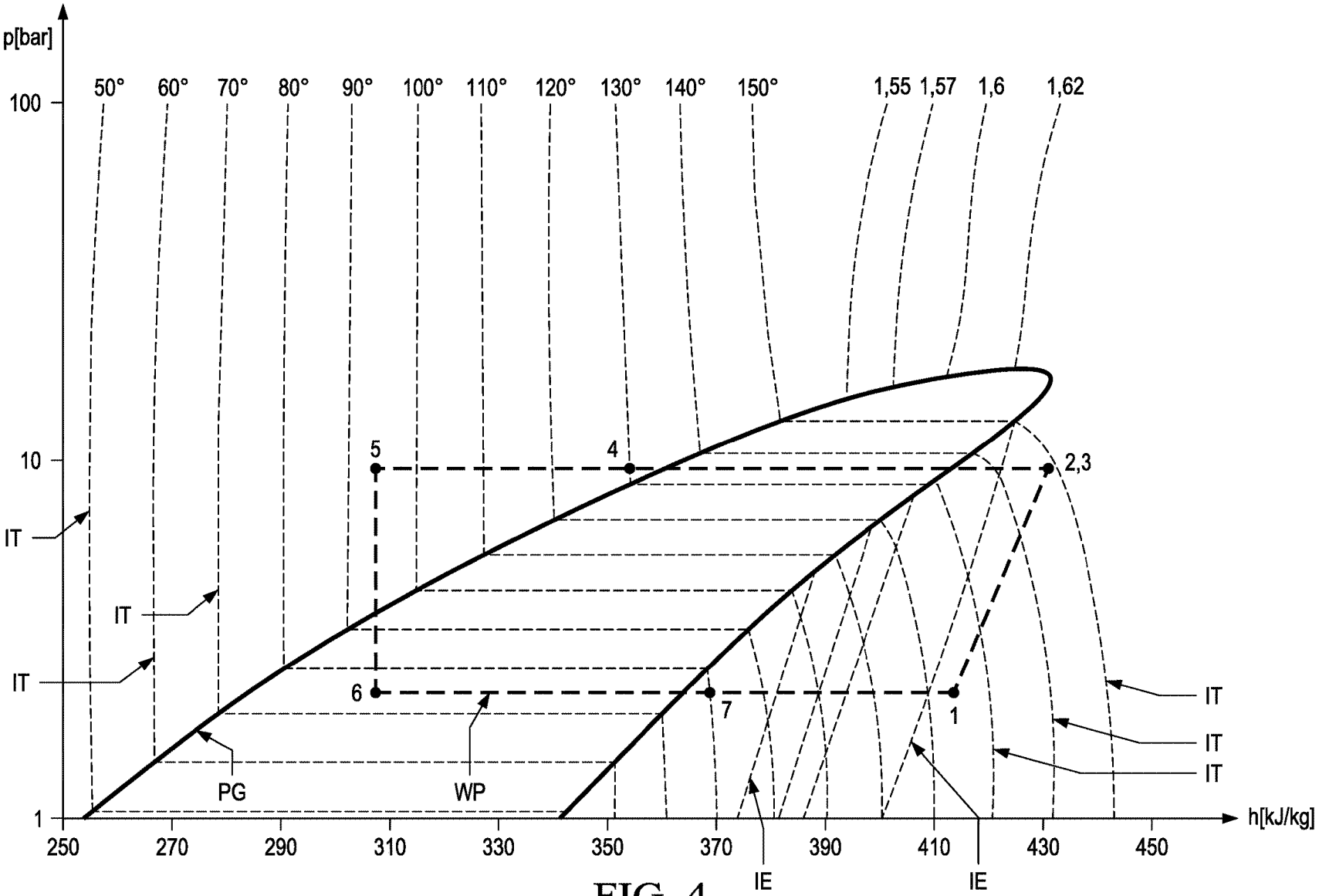
FIG. 4 shows a logarithmic pressure-enthalpy diagram of the working medium as in FIG. 1, with a heat pump process involving a temperature lift of 60 kelvin.

As shown in FIGS. 3 and 4, the temperature lift of the heat pump process WP changes depending on whether the exchanged quantity of heat $Q_{IHX}$ through the internal heat exchanger IHX for superheating the intake gas upstream of the compressor 11 is sufficient to place the compression end point 2 in the gas phase region g.

For example, FIG. 3 shows, once again, a heat pump process WP with the working medium Novec649™ as shown in FIG. 1, but having a condensation temperature of only 95° C. This temperature lift of 20 kelvin is therefore below the limit value for this system. The internal heat exchanger IHX would, in this example, operate with a power of 0.64 kW.

The heat pump process WP shown in FIG. 4 has a very high temperature lift of 60 kelvin, up to a condensation temperature of 135° C. In the case of this heat pump process WP, the internal heat exchanger IHX operates with a power of, for example, 5.9 kW. In this case, the compression end point 2 is very far removed from the dew line TL, such that the temperature lift is far greater than the limit value of the temperature lift for this system of heat pump 10 and working medium.

The exemplary values for the transferred heat power $Q_{IHX}$ through the internal heat exchanger IHX relate to a condenser power of 10 kW. It is therefore impossible in these examples, in the case of a small temperature lift of 20 kelvin, to transfer sufficient heat to maintain a minimum difference of for example 5 kelvin for this system. In the case of a temperature lift of 60 kelvin, however, the transferred heat $Q_{IHX}$ of the internal heat exchanger IHX is sufficient for the minimum difference. The temperature lift of 60 kelvin is therefore above the limit temperature lift for this system. For the system, described here by way of example, of a heat pump 10 with Novec649™ and 10 kW of condenser power at an evaporation temperature of 70° C., the limit temperature lift is 37 kelvin. If for example Novec524™ were used as working fluid with otherwise identical parameters, the limit temperature lift would be 31 kelvin.

It is therefore accordingly possible to determine, for each heat pump-working fluid system, a limit temperature lift above which an internal heat exchanger IHX the necessary heat for maintaining in order to maintain the minimum difference between the compression end point 2 and the dew line TL. If the temperature lift is below the limit temperature lift, it is necessary to work with a system as described in this application in order to ensure the compression end point 2 at the minimum distance from the dew line TL. Only thus is it possible to bring about stable stationary operation with fluids of low dew line gradient in heat pumps 10.

Figure 5:
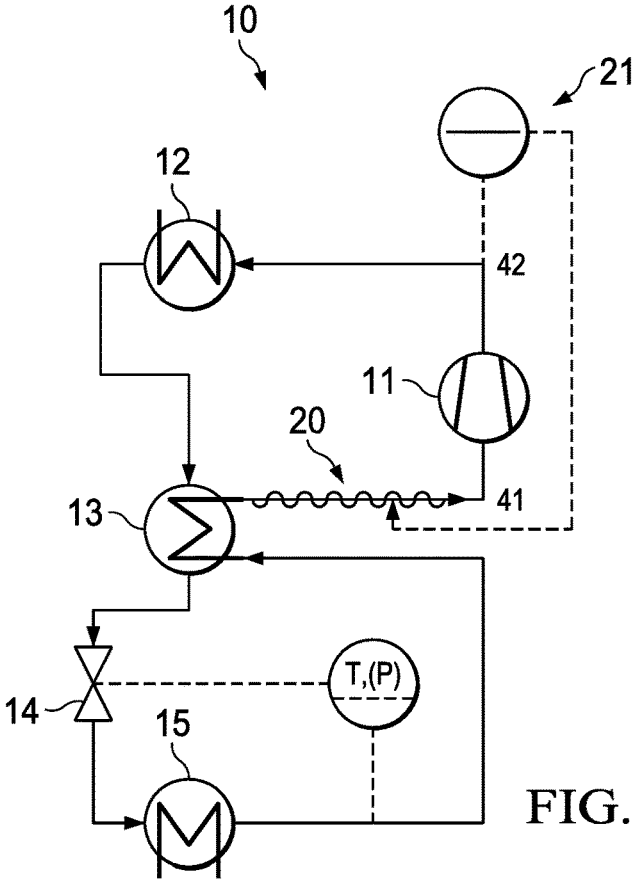
FIG. 5 shows a circuit diagram of a heat pump with a pipe heating unit.
Figure 6:
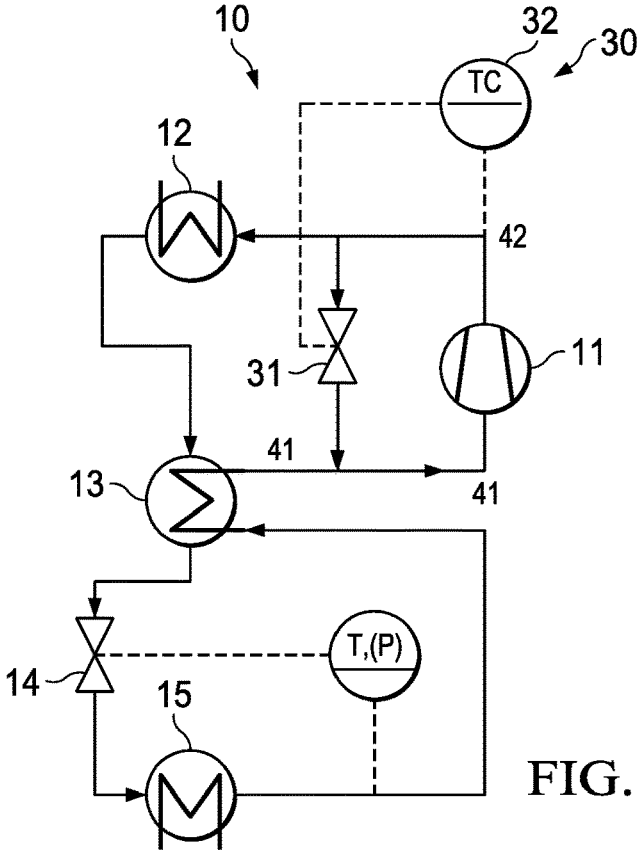
FIG. 6 shows a circuit diagram of a heat pump with a hot gas bypass.
Figure 7:
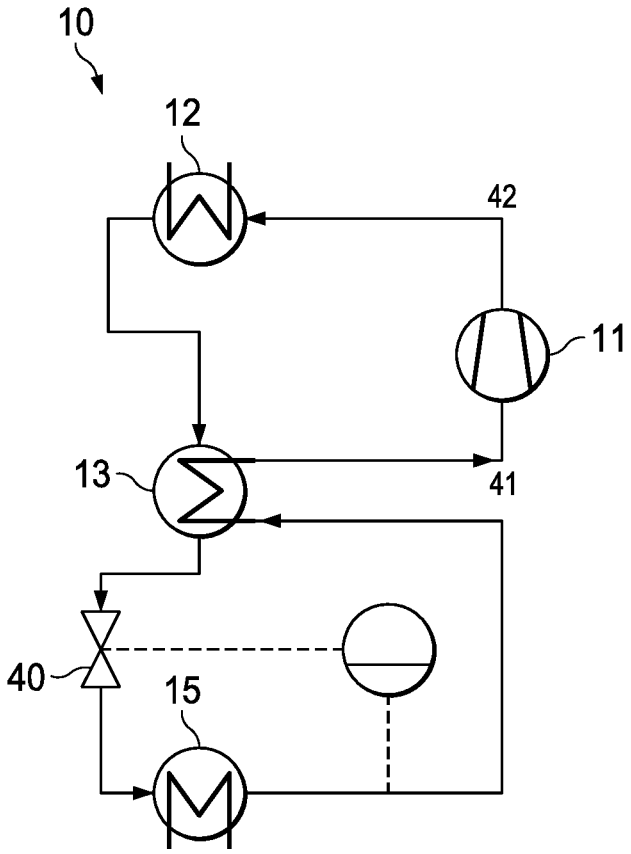
FIG. 7 shows a circuit diagram of a heat pump with an automatic expansion valve.

FIGS. 5 to 7 show embodiments of heat pumps 10 with various control possibilities for the use of novel working media. These make it possible for heat pump processes WP with too-low temperature lift below the limit temperature lift to still be operated in a stable and stationary manner. The starting point is in each case an evaporation temperature of 70° C. and a condensation temperature of 100° C., that is to say a temperature lift of 30 kelvin which, in both exemplary cases for the working fluid Novec649™ and for Novec524™, would lie below the limit temperature lift. The power of condenser 12 is for example 10 kW. FIGS. 5 and 6 show two alternative temperature controls. In these cases, the heat pump 10 is operated with a conventional expansion valve 14 which can for example be a thermostatically or electronically controlled expansion valve 14. This expansion valve 14 controls the throughflow of the working fluid and the superheating downstream of the evaporator 15. Between the internal heat exchanger 13 and the compressor 11, a pipe heating unit 20 is then arranged around the pipe section between the internal heat exchanger 13 and the compressor 11. This pipe heating unit 20 makes it possible to heat the working medium flowing therein. The amount of heating performed by the pipe heating unit 20 on the working medium in state 1 at the low pressure region at the inlet 41 of the compressor 11 is controlled via the temperature T2 in state 2, that is to say at the high pressure outlet region 42 of the compressor 11. To that end, the temperature T2 is measured there and, via a comparison with a minimum difference with respect to the temperature T1, the heating is switched on or off or its heating power is reduced or increased.

The temperature control device 30 shown in FIG. 6 comprises a hot gas bypass 31 which recirculates compressed gas from the pressure side 2 of the compressor 11 to the suction side 1 of the compressor 11 and thus further heats the intake gas by means of the hot compressed gas. The increase in the temperature $T_1$ of the intake gas is limited by a bypass valve 31 which is in turn controlled via the temperature $T_2$ in state 2, by a temperature-based control 32. The valve 31 can be a thermostatically or an electronically controlled valve 31. The additional power required for this temperature control 30 is for example 0.58 kW, this being an additional compressor power in the case of an isentropic increase in pressure and temperature.

Finally, FIG. 7 shows an alternative embodiment for the temperature control 30, namely control via the intake gas pressure: by using an automatic expansion valve 40, that is to say a pure evaporator pressure control valve, it is possible to set the evaporation pressure and thus the evaporation temperature. Lowering the pressure in the evaporator 15 makes it possible to increase the pressure ratio that the compressor 11 has to implement, and thus also the compressed gas temperature $T_2$ in state 2. For the example with the temperature lift of 30 kelvin from 70° C. to 100° C., the pressure would be lowered from 1.96 bar to 1.35 bar in order to thus maintain the minimum difference of 5 kelvin. To that end, in the case of an isentropic increase in pressure and temperature, it is for example necessary for the compressor 11 to provide additional compressor power of 0.45 kW.

It is possible, with the control possibility using an automatic expansion valve, as shown in FIG. 7, to also resolve another problem case which can arise with the novel working media: when the temperature lift is very far above the limit temperature lift. Too great a difference between the compression end point 2 and the dew line $T_2$ can therefore be problematic because the compressor 11 can have an upper operational temperature limit. However, the automatic expansion valve 40 makes it possible to raise the pressure in the evaporator 15 to the point that the fluid is only slightly superheated or even only partially vaporized in the evaporation process. The superheating which may still be necessary at that point for the minimum temperature difference could once again be provided by means of the internal heat exchanger 13. It is thus possible, with this temperature control, to bring about a pressure increase which raises the overall efficiency of the heat pump 10, since lowering the temperature at state points 1 or, respectively, 2 also reduces the pressure ratio $P_{ratio}$ and accordingly less compressor power is required, at the same time the density of the fluid increases which brings about a higher power density in the compressor 11. In addition, due to the lower compressed gas temperature $T_2$, an increased service life of the compressor 11 can be assumed.

What is claimed is:

1. A heat pump comprising:

a compressor having a compressor inlet configured to receive a working fluid into the compressor and a compressor outlet configured to output the working fluid from the compressor, a condenser, an internal heat exchanger, an expansion valve, an evaporator, and a temperature control device comprising a bypass valve and operable to recirculate the working fluid from the compressor outlet to the compressor inlet through the bypass valve, wherein the bypass valve limits an increase in the temperature of an intake gas entering the compressor based on a comparison of the temperature of the working fluid at the compressor outlet to a predefined minimum temperature difference above a temperature of the working fluid at the compressor inlet, and wherein the working fluid output from the bypass valve is combined with the working fluid output from the internal heat exchanger and the combined working fluid passes to the compressor inlet.

2. The heat pump of claim 1, wherein the temperature control device is configured to bring the temperature of the working fluid at the compressor outlet to a minimum temperature difference of at least 1 kelvin above the dew point.

3. The heat pump of claim 1, wherein the working fluid has a dew line with a gradient of less than 1000/kJ in an associated temperature-entropy diagram.

* * * * *